United States Patent [19]

Iams et al.

[11] Patent Number: 4,886,050

[45] Date of Patent: Dec. 12, 1989

[54] DEVICE PERMITTING A USER TO SIMULATE CRAWLING MOTIONS TO IMPROVE MOVEMENT OF THE TRUNCAL MUSCLES AND SPINE

[75] Inventors: John F. Iams, Poway; Robson L. Splane, Jr., Granada Hills; John A. Drusch, III, Escondido, all of Calif.

[73] Assignee: Superspine, Poway, Calif.

[21] Appl. No.: 265,828

[22] Filed: Oct. 31, 1988

Related U.S. Application Data

[62] Division of Ser. No. 844,073, Mar. 25, 1986, Pat. No. 4,789,475.

[51] Int. Cl.[4] ..... A61H 1/02

[52] U.S. Cl. ..... 128/25 R; 434/255

[58] Field of Search ..... 272/70, 71, 93, 127, 272/134, 144, 146; 128/25 R; 434/254, 255

[56] References Cited

U.S. PATENT DOCUMENTS

| | | | |
|---|---|---|---|
| 1,620,146 | 3/1927 | Walton | 272/71 |
| 2,019,224 | 10/1935 | Hess | 272/71 |
| 3,362,090 | 1/1968 | Adam | 434/255 |
| 3,363,335 | 1/1968 | Burhns et al. | 434/255 |
| 3,460,272 | 8/1969 | Pellicore | 434/255 |
| 3,538,911 | 11/1970 | Emmons | 128/25 R |
| 3,568,666 | 3/1971 | Dunn | 128/25 R |
| 3,582,069 | 6/1971 | Flick | 434/255 |
| 3,589,720 | 6/1971 | Agamian | 272/80 |
| 3,759,511 | 9/1973 | Zinkin et al. | 272/70 |
| 3,912,262 | 10/1975 | Micko | 272/144 |
| 3,976,058 | 8/1976 | Tidwell | 128/25 R |
| 4,324,399 | 4/1982 | Rickey | 272/144 |
| 4,422,634 | 12/1983 | Hopkins | 272/71 |

OTHER PUBLICATIONS

R. Cailliet, *Low Back Pain Syndrome* (Edition 3), ch. 4, pp. 79–106, [Note esp. FIGS. 61, 62, and 64 and 67–69], (1981).

"The Auto-Trac Table"—advertising brochure—dated "1985"—Marked Patent Pending.

Advertising brochure for "Exer-Cor Cross Pattern Creeper"—(1985) European-origin device referred to on p. 3 of Specification.

*Primary Examiner*—Richard J. Apley
*Assistant Examiner*—J. Welsh
*Attorney, Agent, or Firm*—Dressler, Goldsmith

[57] ABSTRACT

Apparatus is described which allows a user to simulate crawling motions and provides enhanced movements of the person's truncal spinal muscles and joints. The apparatus comprises a first means for supporting a person in position where there is minimal axial gravity loading of the spine and second means to permit relative motion between axial portions of the spine trunk, especially the upper (thoracic) and lower (pelvic) portions of the person's trunk, while the person remains in the gravity unloaded position. The device contains a fixed portion and a pivoting or swiveling portion, the swiveling portion comprising a pair of pivoted supports which can move in circular lateral paths independent of each other. In the preferred embodiment the user assumes an all fours position and by kneeling or leaning on the swiveling portion engages in a crawling motion alternating movements of each leg or arm, which causes the upper and lower portions of the trunk to move relative to each other. Normal motion is simultaneously in the frontal and traverse planes of the body. Movement in the transverse plane can be enhanced by incorporating a sloped structure for the swiveling portion of the device to follow. Simultaneous movement in the sagittal plane can also be obtained by having the user flex or extend his body during the exercise. The supports for the hands and knees can be mounted on the same base, mounted in a telescoping or adjustable fashion or positioned in separate but adjacent locations. Extra supports can be used if a person is unable to support one or another portion of his body on his own. The pivoting supports can be moved either by the person's own exertions or his exertions can be separately assisted by air cylinders.

6 Claims, 4 Drawing Sheets

FIG. 3
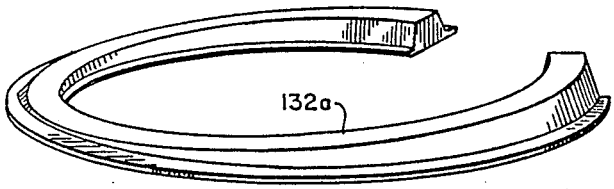
FIG. 4
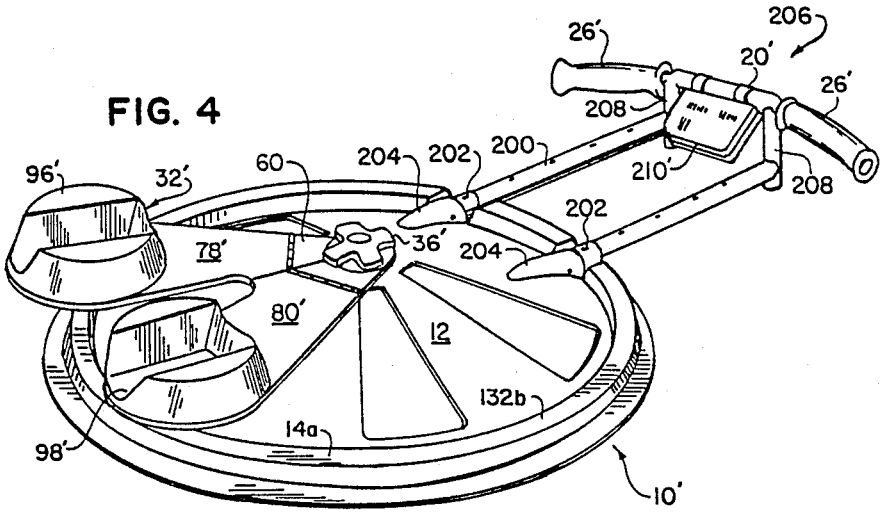
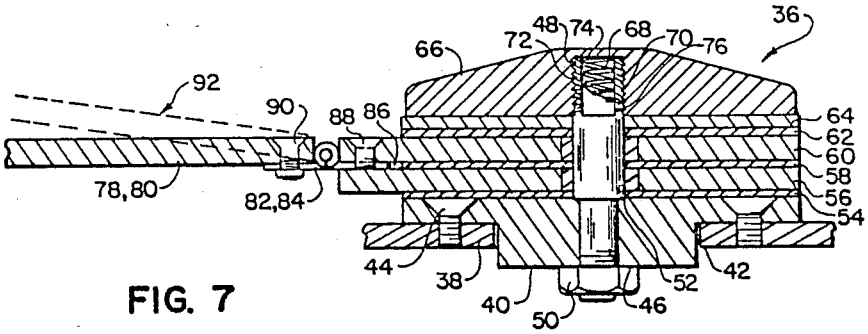
FIG. 7

DEVICE PERMITTING A USER TO SIMULATE CRAWLING MOTIONS TO IMPROVE MOVEMENT OF THE TRUNCAL MUSCLES AND SPINE

This is a division of application Ser. No. 06/844,073, filed Mar. 25, 1986, now U.S. Pat. No. 4,789,475.

BACKGROUND OF THE INVENTION

1. Field of the Invention

This invention relates to devices for moving and/or exercising primarily the truncal muscles and spine joints.

2. Prior Art of the Invention

The muscles in the lower spinal ("paraspinous") area (the lower thoracic, lumbar and sacral portions of the spine) and the corresponding spinal joints represent a portion of the human body which in an adult is frequently the cause of discomfort. In many cases this is due to lack of exercise of and postural strain on those muscles and joints. The common play activities of children, which include significant amounts of stretching, bending and other movements of the trunk, keep the paraspinous muscles and joints limber. The relatively sedentary activities of adults, however, include few of such movements, so that the muscles and joints become much stiffer and movement becomes limited and often painful. For instance, when a person unaccustomed to such work spends a spring weekend strenuously preparing a back yard garden by doing extensive digging, hoeing, raking and the like, he puts considerable stress of the paraspinous joints and muscles. The next day the person finds that his lower back area is extremely sore and movement is difficult. Similarly, when a person engages in sports activities such as golf or tennis which require considerable spinal motion, he may suffer resultant lower back pain and restricted movement even if he is accustomed to such activity. These types of problems could be overcome and prevented if there were means available to exercise the paraspinous muscles and joints in an effective manner.

Pain in the lower spinal region and restricted movement may also occur from injury or unexpected stress to the region. It is commonly found that under such conditions muscles go into spasm, which can be defined as involuntary contraction. Under such conditions the person suffers pain and restricted motion, and cannot overcome the spasms because the muscles are not subject to his voluntary control. It is often very difficult to reduce or eliminate the spasm and alleviate the pain and restriction of motion.

There have in the past been a number of devices designed to provide exercise to the lower spinal region. In these devices the user stands or sits in a predetermined position and then goes through bending and twisting motions. While these devices can be useful to provide exercise to one who is already reasonably fit, it is commonly found that those who need exercise to overcome muscle and joint pain and stiffness due to prior inactivity or muscle spasm find the devices difficult and painful to use. In many cases the pain resulting from use of the machines is so great that the user cannot continue the exercise.

In addition, many of these prior art machines must be manipulated by the user against resistance. The devices, therefore, provide no help for a person who is unable to move his lower spinal region, but who would benefit from such motion induced by external means. This is typically the case when a person suffers muscle spasm.

All of such devices also force the user to move or exercise in an environment where the spine is under significant axial loading induced by gravity. This causes the facet joints to be more closely interlocked and therefore additional muscular effort is required to move the lower spine. The problem is compounded if the person also suffers with any degree of arthritis. The additional muscular effort needed to overcome the gravity loading has two adverse effects: it prevents the healthy user from obtaining the maximum muscle and joint movement since a portion of the person's muscular effort is wasted in overcoming the gravity loading, and it further inhibits the motion of those who already have restricted motion. It can also induce pain or increase the amount of pain already present. Consequently, the conventional exercise machines are limited in a degree to which they can provide effective lower spinal motion.

It has been known that a person's body can be placed in a position in which there is little or no axial gravity loading of the spine. For instance, a person lying horizontally prone or supine has the spine in an essentially unloaded position. In such a position, however, one cannot by himself perform effective exercise of the lower spinal region and there are, to our knowledge, no machines which can effectively assist him. Similarly, a degree of gravity unloading of the spine can be provided by applying traction while the person lies generally horizontally, as occurs in a traction arrangement called "semi-Fowler position". However, the person in traction cannot perform effective movement or exercise of the lower spinal region.

There have been devices intended to provide an approximation of a human adult crawling motion. One such device, of European origin, utilizes two parallel tracks oriented axially of the user's body. The user kneels in a crawling position with his hands and knees resting on wheeled supports mounted on the tracks. The user can then move hands and knees forward and backward in a straight line parallel to the axis of the body. Because the axially oriented tracks constrain any other motions, however, there is no significant movement of the lower spinal region, particularly the truncal muscles and spinal joints, since all movement occurs at the hip and shoulder joints. Another such device is illustrated in U.S. Pat. No. 4,324,399.

It would therefore be of significant value to have available a device which would enable a user to obtain the maximum degree of motion of the paraspinous muscles and joints. Healthy users could obtain optimum strengthening of the lower spinal region while those with limited movements and/or pain could lessen or eliminate the pain and improve the degree of available motion.

BRIEF DESCRIPTION OF THE INVENTION

In its broadest embodiment, the invention herein is a device for providing simulating crawling motions and providing enhanced movement of a person's truncal muscles and spinal joints, which comprises:

a. first means for supporting the person in a position in which there is minimal gravity induced axial loading of the person's spine; and b. second means permitting the person to cause simultaneous lateral motion and extension or flexion of one limb independently of opposed lateral motion and flexion of extension of the companion limb, with associated relative motion between axial portions of the person's trunk while the person remains in said position.

In a more particular embodiment the person's position is one defined as the "all fours" position. In other preferred embodiments the relative motion between the two portions of the trunk involves simultaneous movement in at least two, or in all three, of the major bodily planes.

In a specific embodiment the device comprises a base intended to be disposed horizontally and having thereon rests to engage the user's hands and knees, with one of the rests being fixed and the other pivotally mounted on the base, such that the user can assume an all fours position on the device with the hands engaging one rest and the knees engaging the other rest. The pivotally mounted rest element is divided axially, so that the user positions one knee (or one hand) on each half of the element. The user can then move each half of the pivotal rest independently in a circular path. This allows each leg (or arm) to move independently of the other leg (or arm) in a lateral circular motion which also involves alternate flexion and extension of the limb. As each limb moves independently, the user alternates the limb motions with one limb being extended when the other is flexed, so that the user effectively goes through crawling motions. The simultaneous lateral motions of the limbs cause significant motion of the spinal region and relative motion between adjacent axial portions of the trunk, such as the thoracic and pelvic portions of the trunk.

Numerous other preferred embodiments will be described in detail below.

BRIEF DESCRIPTION OF THE DRAWINGS

FIG. 3 is a perspective view of a component to alter the path travelled by the pivoting portion of the unit.

FIG. 4 is a perspective view of another embodiment of the device.

FIG. 7 is a side elevation view of a pivot mechanism of the devices of FIGS. 1 and 4.

DETAILED DESCRIPTION AND PREFERRED EMBODIMENTS

Figure 1:
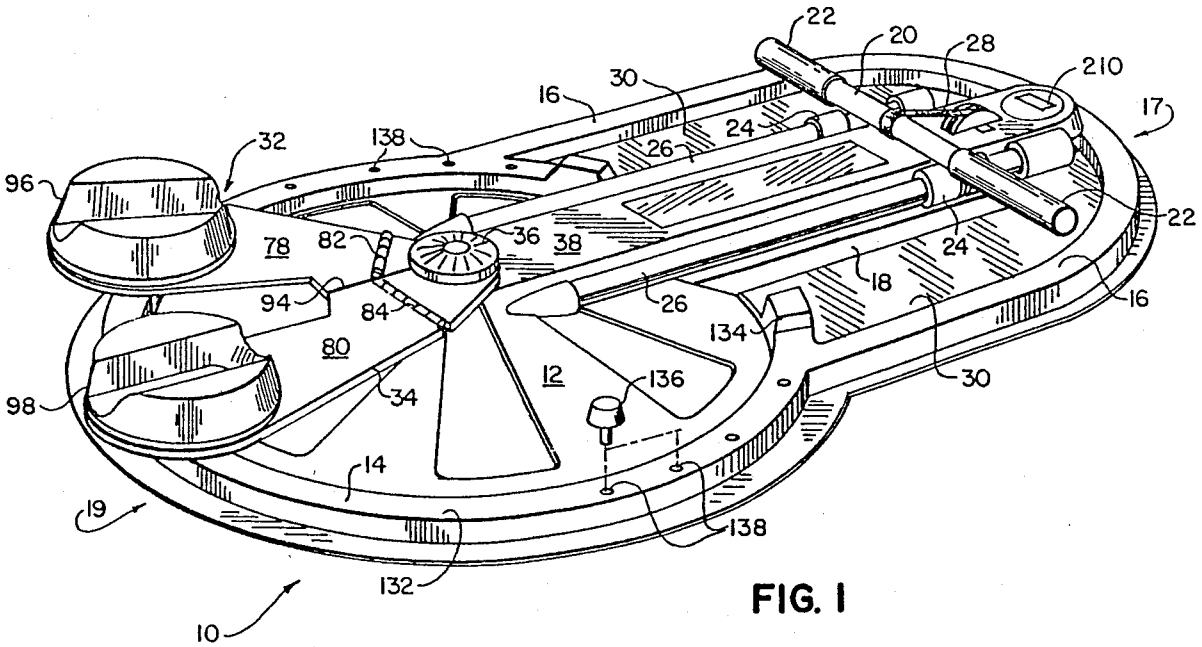
FIG. 1 is a perspective view of one embodiment of the device.
Figure 2:
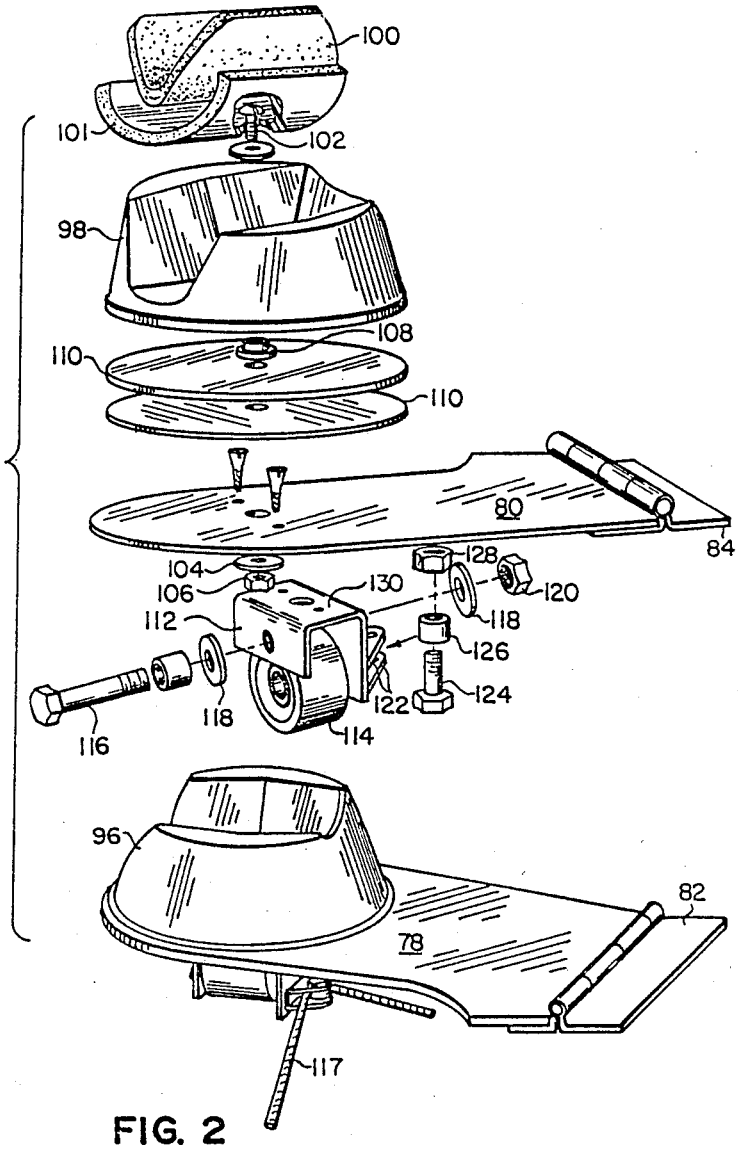
FIG. 2 is a partially exploded view of the pivoting portion of the device of FIG. 1.

The function of the device of this invention to enable a user to simulate the motions of crawling and to enhance movement of adjacent regions of the trunk and spine relative to each other will be best understood by first considering the structure of two specific embodiments of the device of the invention, as illustrated in FIGS. 1 and 4. These are a larger model (shown in FIG. 1) which is suitable for home use as well as use in facilities for physical fitness, physical therapy and sports training. The second (shown in FIG. 4) is a smaller, more portable device which one can readily carry while traveling and use in hotel rooms, as well as using it in the more conventional settings as described for the larger unit.

Depending on the different anatomical effects which are being considered, it is possible to find in the literature a number of different definitions of a person's "trunk" and the related spinal and muscular regions. For the purposes of discussion herein, the trunk will be considered to be the main portion of the body to which the neck, arms and legs are attached, the "thoracic" portion (or "thorax") of the trunk will be considered to extend from the waist upward and the "pelvic" portion (or "pelvis") will be defined to extend from the waist downward. It will be recognized, of course, that the spine and muscles represent a continuum so that reference to motion of one part of the trunk relative to an other part represents varying degrees of segmental motion rather than abrupt change of direction at an isolated point.

The larger unit is designated 10 in FIG. 1. The foundation of the unit is base 12 which in this embodiment is an elongated relatively flat base intended to be placed on a floor or other generally horizontal surface. It is shown in the embodiment of FIG. 1 as having an approximately oval shape, but other shapes such as rectangular, elliptical, ovate and the like would also be suitable. As designed for use by adults, it normally has dimensions of approximately 3 to 4 feet long and 2 to 2.5 feet wide (0.9 to 1.2 m long by 0.6 to 0.45 m wide). These dimensions may be varied somewhat, however, to accommodate users of different sizes. In addition, the base may be tapered toward one end or may be narrower near the middle so that the width and length dimensions need not be uniform overall.

As shown, the base is relatively thin and strengthened by ribs 14, 16, 18 and 38. It is preferred that the base be made of a strong plastic material, since it may then be manufactured easily by such techniques as injection molding or vacuum forming, but it may also be made of other common materials such as aluminum, steel, wood or fiber reinforced plastics.

The device 10 has two ends which for convenience in the following discussion will be designated at the "front" (the end 17 to the right in FIG. 1) and "rear" (the end 19 to the left in FIG. 1). As will be evident from FIGS. 5 and 6, however, the unit may be used by a person facing in either direction, so the respective terms "front" and "rear" are to be understood herein to be used merely for convenience in discussion and not to be limiting structurally.

Near the front end 17 of the device 10 is located a bar 20 having at the outward ends thereof hand grips 22. In the simplest embodiment of this device the bar 20 is fixed at a point adjacent the front end 17 by securing it directly to the base 12 through the use of a short spacer or upstanding post or rib which elevates it sufficiently above the surface of the base 12 to enable a user to grip the hand grips comfortably. The bar 20 should not be elevated too much above the base 12, however, for that would tend to align the user's spine in a position in which there is a significant amount of gravity loading. A distance of 3 to 6 inches (7 to 15 cm) is quite sufficient.

In a more preferred embodiment the bar 20 is mounted on sleeves 24 which in turn are slideably mounted on rods 26 aligned axially of the base 12. This allows the user to move the hand bar 20 closer to or farther away from him and permits the unit to be adapted easily to taller or shorter people. An adjustable strap 28 may be used to limit the positioning of the bar 20 or, alternatively, there may be a series of holes drilled along the length of rods 26 to correspond with holes drilled through bar 20 at its intersections with rods 26 such that by use of pins (not shown) the bar 20 may be fixed in any of a number of positions along the length of rods 26.

Also mounted toward front end 17 and extending axially along base 12 toward the rear end 19 are pads 30. These are conveniently recessed between ribs 16 and 18 and provide support for user's knees in a manner shown in FIG. 6.

Toward the rear end 19 of base 12 of device 10 is swivel member 32. Swivel member 32 divided into two halves 34 and 35 which are formed from supports 78 and 80. These supports 78 and 80 meet in a V shape and are connected to pivot member 36 at the point of the V. This allows them to pivot about pivot member 36 (incorporating pivot pin 48) to provide the required lateral and rotational motions of the user's spine and trunk. The two halves 34 and 35 meet at line 94. Actual connection of the supports 78 and 80 to pivot member 36 may be through hinges 82 and 84 or may be direct if elevation (discussed below) is not desired.

As shown more fully in FIG. 7, pivot member 36 is attached to the central rib 38 of base 12 by means of insert collar 40 which is recessed into opening 42 in central rib 38. Countersunk screws 44 hold the collar 40 and rib 38 together. Extending through a hole 46 in the center of collar 40 is pivot pin 48 which is secured at its lower end by nut 50 and rests on the top of collar 40 on circumferential shoulder 52, from which it projects upwardly through the remainder of the pivot member 36 structure. Mounted sequentially above collar 40 are friction material 54, support plate 56, spacer 58, support plate 60, friction material 62 and washer 64, all surmounted by screw cap 66. Screw cap 66 has mounted thereon a centrally located internal spring 68 which fits into recess 70 in the top of pin 48. External threads 72 on pin 48 mate with corresponding internal threads in the central hole 74 of screw cap 66. The top portion 76 of pin 48 (at least above friction material 62) has a cross section in the form of a truncated circle matched by the corresponding central hole in washer 64, such that elements 56, 58 and 60 with circular central openings can pivot around pin 48, but washer 64 is fixed in a nonpivoting position. Consequently, as compression screw cap 66 is tightened or loosened by rotation along threads 72 the entire assemblage of elements 54 to 62 is compressed or released, thus varying the force needed to pivot swivel member 32 on pin 48.

The friction materials 54 and 62 may be materials of moderate or low friction depending on the desired ease of movement of swivel member 32. Tetrafluoroethylene ("Teflon") or other polymeric plastic disks or smooth or matte surfaced metal disks may be used, as could be disks of lubricated fibrous materials. The other components of swivel member 32 are preferably made of metal or strengthened plastics.

The supports 78 and 80 are preferably hingedly mounted to pivot 36 through hinges 82 and 84 respectively. The hinges 82 and 84 are attached to pivot 36 by being placed between extensions of plates 56 and 60 in the space 86 created by spacer 58. They are then secured by bolts or similar fasteners 88 passing through the extensions of plates 56 or 60, respectively, so that they can swivel independently and permit the user to move through crawling motions comfortably. Similar bolts or fasteners 90 secure supports 78 and 80 to the outer leaves of hinges 82 and 84, allowing the supports 78 and 80 to pivot upward as illustrated at 92 in FIG. 7.

Figure 5:
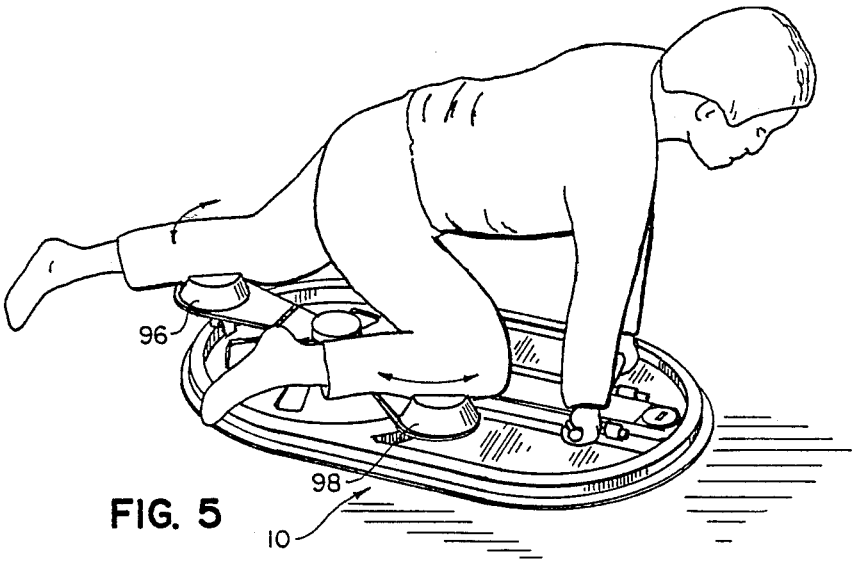
FIG. 5 illustrates a method of use of the device in which the legs and lower body are moved and the arms and upper body remain stationary.

Mounted on each of supports 78 and 80 is a knee rest 96 or 98 respectively. Each knee rest 96 or 98 is molded with a central V shaped pocket to accommodate the user's knees as shown in FIG. 5. For comfort, cushion pads 100 are mounted in each knee rest 96 or 98. These cushions 100 may be of disposable closed cell foam material or a washable material such that they can be discarded or cleaned after use. Knee rests 96 and 98 are secured to the supports 78 and 80 by bolts 102, washers 104 and nuts 106. An intermediate cushioning material 101 may be inserted between the rest 96 or 98 and cushion 100 to secure the end of bolt 102 and allow cushion 100 to cover the bolt head. Bushings 108 may be inserted to position the bolts. Shims 110 can be added in any desired number to fix the height of rest 96 or 98 above the support 78 or 80. If it is desired to keep the rests 96 and 98 in fixed position, locks or shims made of materials with substantial surface friction can be used to resist twisting of the rests. It is preferred, however, that the rests 96 and 98 should be able to turn individually so that they can swivel independently and permit the user to move through crawling motions comfortably. Therefore, one or more of the shims 110 should be made of a material with a low surface friction, such as a Teflon material.

The knee rests 96 and 98 can also be made to raise or lower independently by various means, such as by screw mounts or by inserting additional or thicker shims 110 under one or both rests 96 or 98, so that a user can be positioned with one hip or shoulder elevated. This may be useful in focusing on motion of individual muscles or vertebrae.

Mounted on the underside of the supports 78 and 80 are brackets 112 on which are mounted wheels 114 rotating on axle bolts 116 which are secured with washers 118 and nuts 120. Projecting from the inner side of brackets 112 are lugs 122 on which are mounted adjusting bolts 124 through bearings 126 and secured with nuts 128. The lugs 122 project inwardly from inward sides 130 of brackets 112 so that when threaded through bearings 126 and nuts 128 the end of bolts 124 bear against the underside of support 78 or 80. This permits the angle of wheels 114 to be adjusted by rotation of bolts 124.

Wheels 114 ride on the track 132 formed on the top of rib 14. The radius of rib 14 and track 132 is fixed by the distance between the center of the treads of wheels 114 and the center of pivot pin 48, such that the entire swivel member 32 rotates around pivot pin 48 and rides on wheels 114 rolling on track 132. The length of track 132, i.e. the segment of the circle which it defines, is fixed by end stops 134, or if a shorter path is desired, by removable stops 136 placed in any of a number of holes 138 drilled in rib 14. By means of adjustable stops 136 the distance which the supports 78 and 80 pivot to either side of the axis of the unit 10 can be independently fixed. Each support 78 or 80 can thus swivel outward to a stop 134, a shorter length to a stop 136 or, if a stop 136 is placed immediately outwardly of a wheel 114 on either support 78 or 80 when the supports are axially centered, either of the supports 78 or 80 can be restrained from outward lateral movement while the other support is moveable, thus permitting exercise focused on only one side if desired.

A bungee cord 117 may be threaded around bolt 124 and bearing 126 inside bracket 122 on each wheel assembly and anchored at its ends to the underside of base 12 by conventional means. The elasticity of the bungee cord 117 will be chosen to provide the desired degree of additional resistance to the person's swiveling motions to increase the amount of exercise effort expended. If desired one end of the bungee cord 117 may be anchored in an adjustable manner, so that by extension or slackening of the cord different amounts of resistance may be imposed.

FIG. 3 shows an accessory unit 132*a* which can be mounted over the top of rib 14 and which provides an inclined path for the swivel member 32 to follow. It is with this accessory track 132*a* that the hinged features of member 32 and supports 78 and 80 are necessary. As the member 32 swivels around on track 132*a* the individual supports 78 and 80 rise or fall with the elevation of the track. This causes a component of rotation in the body movements of the user which adds an additional degree of spinal or muscular motion.

It will be understood that the member 32 will function quite adequately if the supports 78 and 80 are not hinged at all. However, this limits the device 10 to having only the horizontal track 132 and precludes the use of inclined track 132*a*. Either type of structure may be preferred under different circumstances. The unitary nonhinged structure is simpler and less expensive to construct, and so might be very desirable for those who get adequate benefit from the movement only in the horizontal plane along track 132 and who wish to have an "economy" unit. On the other hand, the hinged device, while more complex and expensive, provides a wider range of possible motions and is thus more desirable for those who wish to have a more comprehensive exercise program.

FIG. 4 illustrates another embodiment of the apparatus of this invention. For the most part, the devices 10 and 10' of FIG. 1 and FIG. 4 are very similar and the pivoting portions are essentially identical. The major elements are indicated by like numbers with the prime symbol appended in FIG. 4. Reference is made to the descriptions above for details of each of these elements.

In the FIG. 4 device 10', the track 132*b* on which the supports 78' and 80' of swivel member 32' ride is the top surface of rib 14*a* which is circular and forms the outside border of the device 10'. Instead of a projection toward the "front" end 17 of the device 10 in FIG. 1, the device 10' in FIG. 4 has rods or bars 200 which project outwardly from sleeves 202 and can telescope under base 12' of device 10' through raised elements 204. If desired, the rods or bars 200 may themselves be telescoping which would allow the hand unit 206 to be extended farther away from the base 12' than would be possible if the entire length of rods or bars 200 had to be accommodated under the base 12'. The hand unit 206 is attached through supports 208 to rods or bars 200 and has a central bar 20' to which are mounted hand grips 26'. If desired an accessory such as inclined track 132*a* can be placed over rib 14*a* to form an alternate to track 132*b*.

The device 10' of FIG. 4, because it telescopes into a unit which is essentially no greater in diameter than the base 12', can be more readily transported than the device of FIG. 1. One could make the base no greater in diameter than 30 inches (75 cm) thus allowing it to be packed as if it were luggage and transported by the user. Since the knee rests 96' and 98' are demountable by removal of bolts 102 the entire unit can be stored in a relatively flat configuration and easily carried. It can then be opened up and used readily by a traveler in places such as hotel rooms.

A timer, pivot counter or similar device can be mounted at 210 (210').

Figure 6:
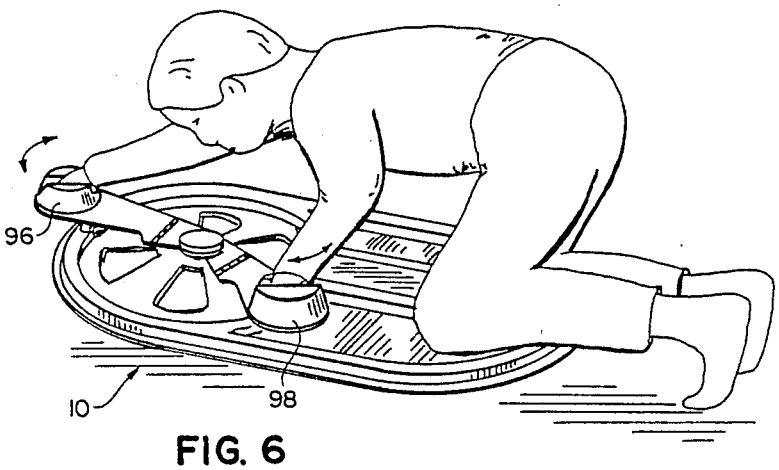
FIG. 6 illustrates a method of use of the device in which the arms and upper body are moved and the legs and lower body stay stationary.

FIGS. 5 and 6 illustrate typical use of the present device. FIG. 5 illustrates what will be termed the "normal" position of the user while FIG. 6 illustrates the "reversed" position. In the normal position the user assumes an all fours position on his hands and knees, with his hands gripping the hand grips and his knees supported by the two knee rests. In both the normal and reversed positions the user's spine is in a substantially horizontal position so that there is minimal axial loading along the spine induced by gravity. Thus the vertebrae can move freely relative to each other. (The downward gravitation force perpendicular to the spine in this position is not important, since it does not tend to compress the spinal joints and affect movement.) Equally significant for the benefits of the present invention, however, the upper portion of the spine and trunk can move relative to the lower portion.

It will be seen that as the user swings his legs alternately to each side in a crawling motion the supports 78 and 80 pivot in circular arcs and cause the pelvis to move off the axial line of the thorax. This lateral motion can be defined as motion in the frontal or coronal plane. The movement in the circular arcs also necessarily provides a degree of rotational motion to the lower spinal area. This rotational motion, which can be described as motion in the transverse plane of the body, is enhanced by use cf the inclined track of the device so that the user's pelvis is rotated and elevated as he manipulates the pivoting portion of the device. Finally, if desired, the user can also flex or extend his spine in the sagittal plane by arching or bowing his back while pivoting his lower body on the device. The device of this invention, therefore, has the unique property of allowing a user to move his spine and truncal muscles in at least two and, when desired, all three bodily planes simultaneously while maintaining the spine in a gravity unloaded position. This maximizes the degree of movement which can be accomplished. It has also been found that frequently this movement can be accomplished with a marked reduction in or elimination of previously existing pain.

In the reversed position illustrated in FIG. 6 the person assumes the all fours position with the knees fixed on the support pads at the front end of the device and places his hands on the swiveling portion. The user places his hands on the rests 96 and 98. If desired, small hand grips (not shown) can be placed in the pockets of rests 96 and 98 to improve the user's hold. The user then moves his arms and shoulders alternately outwardly and in flexion and extension in a crawling motion (corresponding to the leg and hip movements described above), to cause motion of the upper trunk muscles and spinal joints relative to each other and to the lower truncal muscles and joints.

The normal and reversed positions for the user provide motion of the thorax relative to the pelvis. However, the particular muscles and spinal portions moved and exercised are not fully identical. While we do not wish to be bound to a specific physiological explanation for the beneficial effects observed by use of these devices, we believe that the thoracic spine and paraspinous muscles are exercised by both the normal and reversed exercise modes. Additionally, in the normal mode the paraspinous transversospinal and quadratus lumborum muscles are affected, while in the reversed mode the upper thoracic spine and the latissimus dorsi muscles are exercised.

It will be seen in the drawings that the pivoting motions of the device are provided by the exertions of the user. The device may, however, if desired, be adapted for use by persons whose ability to generate such movements is limited. Such would be the case, for instance, with a person who is suffering from severe muscle spasms and is unable to exert the force necessary to move these portions of the body because of the intense pain generated. It is therefore contemplated that the device of this invention could be adapted so that the swiveling portion would be driven by an outside component, thus assisting the user in his muscular efforts. For instance, there could be air cylinders on either side connected separately to supports 78 and 80 which could be alternately filled and emptied, thereby urging the supports alternately in reciprocating pivoted motion. Other satisfactory drive means will readily suggest themselves to those skilled in the art.

It is also within the scope of this invention to have the support for the upper portion of the body not connected to the support for the lower portion of the body. For instance, in a situation where a user was unable to support himself with his arms as shown in FIG. 5, a separate support for the shoulders could be mounted adjacent to the swiveling portion of the device. A typical example would utilize the device 10' shown in FIG. 4 but with the telescoping arm support retracted and a separate bench or other elevated support placed adjacent to (e.g., over) the base so that the user would still be supported with his spine in a gravity unloaded position but would be resting with his arms and shoulders independently supported. The full benefit of the crawling motion and relative motion of the upper and lower truncal portions and muscles would be obtained.

In a somewhat similar situation, there could be independent means of supporting the entire trunk above the unit in a gravity unloaded position for those individuals, who are unable to support themselves on either hands or knees while exercising. Typically this would be accomplished by providing a sling, bench or saddle-like support straddling the unit and adapted to support the person's trunk in the all fours position so that the hands and knees would rest as shown in FIG. 5 on the device but the person's weight would be borne by the support rather than by his arms and legs. Of course either of these two types of supports can be also beneficial to users of the device who do not have such severe limitations.

Devices of the type shown have been successfully used in controlled environments involving exercise and physical therapy. Marked improvement in the users' truncal mobility have been observed. In addition, instances of back pain reduction has also been noted, such that typically a user suffering from back pain finds exercise on the device of this invention to be easier to perform than exercise on conventional devices which place the spine in a loaded position.

It will be evident that there are numerous embodiments of the apparatus of this invention which are not described above but which are clearly within the scope and spirit of the invention. Consequently, the above description is intended to be exemplary only and the scope of the invention is to be limited solely by the appended claims.

What is claimed is:

1. A method of manipulating a person's truncal muscles and spine comprising:

causing the person to kneel on all fours; while first emplacing a one like pair of the users hands or knees upon a stationary rest; while second emplacing the remaining like pair of the users hands or knees upon moving rests which are reciprocally movable in the arc of a substantially level circle;

moving the remaining pair of the user's hands or knees independently upon the moving rests oppositely reciprocally each along a different portion of the arc of the same substantially level circle;

wherein upon such times as the second emplacing is of the user's two knees then the moving oppositely in the circular arc will cause simultaneous lateral motion in extension or flexion of the user's one leg while there is independent lateral motion in flexion or extension of the user's remaining leg;

wherein neither of the remaining pair of the user's hands or knees moves in a straight line, but rather moves in the arc of a circle, in order that the truncal muscles and spine are manipulated in a natural crawling motion during which the user's hands or knees are not constantly in line with the axis of the torso but rather swing outwards during the crawling motion.

2. The method of manipulating according to claim 1 wherein the moving is about a center to the level circle which center is substantially in vertical alignment with the center of the pelvic portion of the person's unbent spine.

3. The method of manipulating according to claim 1 further comprising:

making the kneeling person to arch his/her back;

therein causing extension in the saggital plane.

4. The method of manipulating according to claim 3 wherein the making the kneeling person to arch his/her back is facilitated by a moving that is not in an exactly level circular arc but is rather in a circular arc that undergoes a slight incline and decline in the path of reciprocal motion.

5. The method of manipulating according to claim 1 that before the first emplacing and the second emplacing comprises:

adjusting the distance of separation between the stationary rest and the moving rest in order to facilitate proper engagement of the hands and knees of a particular user.

6. The method of manipulating according to claim 1 wherein the first emplacing comprises:

fitting the user's both hands to grasp a stationary bar;

and wherein the second emplacing comprises:

fitting the user's both knees to each fit within a receptacle upon the moving rest.

* * * * *